US006305990B1

(12) United States Patent
Ward

(10) Patent No.: US 6,305,990 B1
(45) Date of Patent: Oct. 23, 2001

(54) SEALED ELECTRICAL CONNECTOR WITH SECONDARY LOCKING

(75) Inventor: Bobby Gene Ward, King, NC (US)

(73) Assignee: Tyco Electronics Corp, Wilmington, DE (US)

( * ) Notice: Subject to any disclaimer, the term of this patent is extended or adjusted under 35 U.S.C. 154(b) by 0 days.

(21) Appl. No.: 09/566,324

(22) Filed: May 8, 2000

(51) Int. Cl.[7] ..... H01R 13/514
(52) U.S. Cl. ..... 439/752
(58) Field of Search ..... 439/752, 595, 439/587

(56) References Cited

U.S. PATENT DOCUMENTS

| | | | | |
|---|---|---|---|---|
| 4,684,190 | * | 8/1987 | Clark et al. | 439/578 |
| 4,867,711 | | 9/1989 | Yuasa | 439/752 |
| 4,946,399 | | 8/1990 | Kawashima | 439/752 |
| 4,959,023 | * | 9/1990 | Watanable et al. | 439/753 |
| 4,971,579 | | 11/1990 | Mobley et al. | 439/595 |
| 5,299,958 | | 4/1994 | Ohsumi | 439/752 |
| 5,554,055 | | 9/1996 | Miller | 439/752 |
| 5,782,657 | | 7/1998 | Wolla et al. | 439/595 |
| 5,830,013 | | 11/1998 | Saito et al. | 439/595 |
| 5,928,038 | * | 7/1999 | Berg et al. | 439/752 |
| 6,004,158 | | 12/1999 | Ward | 439/595 |

* cited by examiner

*Primary Examiner*—Neil Abrams
*Assistant Examiner*—Phuong KT Dinh

(57) ABSTRACT

A sealed electrical connector assembly comprises a cap connector 10 matable with a plug connector 100. The cap connector housing comprises a front section 30 and a separate rear section 60, which includes a shroud 61. The two housing sections are attached and two sliding secondary lock plates 40, 50 are trapped between the two housing components. Each secondary lock plate includes a protrusion 41, 51 extending through openings 32 in the front housing section. 30 so that the locks can be shifted from the front of the housing. The plug connector housing has a similar structure. A gasket seal 120 is mounted in the plug connector 110 to engage a lip on the cap connector shroud 61. An alignment plate 20 includes camming fingers that insure that the secondary locks 40, 50 are laterally shifted to a fully inserted position during mating.

40 Claims, 12 Drawing Sheets

SEALED ELECTRICAL CONNECTOR WITH SECONDARY LOCKING

BACKGROUND OF THE INVENTION

1. Field of the Invention

This invention is related to electrical connectors used to connect multiple wires, such as connectors used in an automotive electrical or electronic system in which multiple wires in the same harness are attached to a single electrical connector. This invention is also related to electrical connectors employing primary and secondary locks and to sealed electrical connectors.

2. Description of the Prior Art

Although it is important for electrical connectors in all applications to establish a reliable electrical termination that will not be disengaged under normal operating conditions, automotive applications tend to have more problems with failed terminations than many other applications. The failure of electrical connectors in automotive applications is not only due to the environment in which the connectors are used, but many problems have been traced to errors in assembling the electrical connectors and the harness in which they are employed. With the increased use of electronics in automotive applications these problems can be compounded simply because of the additional circuits and wires that must be joined by the electrical connector.

To overcome these problems, electrical connectors used in automotive applications have used secondary or redundant locking to prevent terminals from being disengaged from the molded housings in which multiple terminals are mounted. Terminal position assurance, which means that the electrical connector assemblies cannot be assembled if terminals are improperly positioned, have been used, and in many prior art connectors, secondary or redundant locks cannot be assembled unless the terminals are properly seated in the housings.

One inherent problem with secondary or redundant locking schemes is that they inevitably take up space. With the increasing number of wires and circuits that must be connected, space often becomes critical. Many electrical connectors have a large number of terminals densely packed in a small space. It is also common to house terminals of different size in the same male or female electrical connector. For example, terminals for supplying electrical power to components in an automobile are commonly housed in the same electrical connector with a large number of terminals connecting signal wires. Each terminal in electrical connectors of this type is typically held in position by a molded resilient primary latch engaging the terminal in its terminal cavity and a secondary or redundant locking member is used either to ensure that the resilient latch does not become disengaged or to independently hold the terminals in the electrical connector. When other common problems, such as the tendency of mating terminals to stub during mating, the tendency of terminals and connector covers to become disengaged when the wires are jerked, and the need to insure that electrical connectors can be assembled and mated in only one orientation must be solved by connector design, it becomes difficult to meet all of these requirements within a given space.

U.S. Pat. No. 6,004,158 discloses an electrical connector assembly that successfully addresses these problems, but the male and female electrical connectors forming that connector assembly are not sealed or waterproof. The use of sliding plate secondary locks with connectors that are sealed at the mating interface and around each wire entering the connector imposes additional problems not addressed by the design of that prior art connector. Furthermore it is important that the molded components of the connector assembly should be molded in relatively simple molds so that the capital cost of the mold tooling does not become prohibitively large. These problems are successfully addressed by the electrical connector assembly comprising the preferred embodiment of this invention.

SUMMARY OF THE INVENTION

An electrical connector according to this invention is matable with a mating electrical connector. This electrical connector has a housing with terminals positioned in the housing. The electrical connector includes a secondary lock that can be shifted parallel to a mating face of the housing into an engaged position in which the secondary lock prevents retraction of terminals from the housing. The secondary lock includes a protrusion extending toward the mating face and accessible by an installer so that the secondary lock can be shifted into an engaged position. Although primarily intended for secondary locking, a locking plate of this type can also function as the primary locking mechanism to hold the terminals in the housing. A shiftable locking plate of this type can be used on a cap or female connector or on a plug or male connector, and in the preferred embodiment, both mating connectors employ a secondary lock of this type.

To align terminals during mating, this electrical connector assembly also includes an alignment plate that guides male or blade terminals into engagement with female or receptacle terminals. In this invention, the alignment plate also abuts secondary locks to shift them to a fully engaged or locked position. The alignment plate is shiftable transversely relative to the shiftable lock plates during mating.

To simplify molding both the cap and plug connectors included separately molded front and rear housing members that when assembled form slots to receive secondary locking plates between the front and rear housings of each connector.

Each of these features, either separately or all together, can be combined into a sealed electrical connector assembly including a cap connector and a plug connector. The cap connector includes a cap housing with a peripheral shroud. The plug connector has a plug housing and a peripheral seal that engages the peripheral shroud when the cap connector is mated to the plug connector. At least one cap locking plate is surrounded in the cap housing on four sides by the shroud. The cap locking plate is shiftable transversely relative to one side of the cap housing and transversely relative to the shroud.

DETAILED DESCRIPTION OF THE PREFERRED EMBODIMENT

Figure 1:
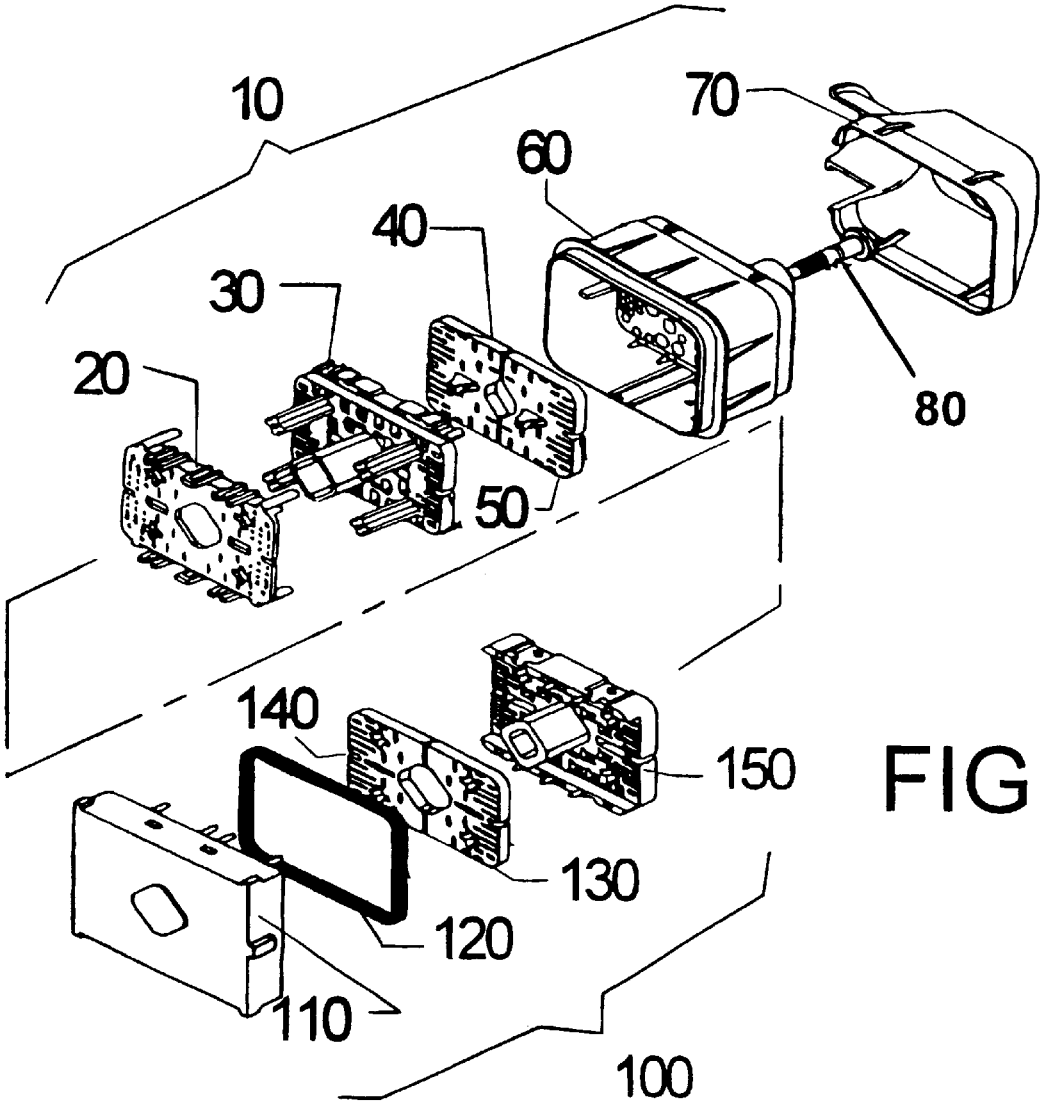
FIG. 1 is an exploded three dimensional view of an electrical connector assembly including a cap connector and a plug connector.

The housing components of a cap electrical connector 10 that is matable to a plug electrical connector 100 are shown in the exploded view of FIG. 1. The preferred embodiment of the cap connector 10 attached to a wiring harness would typically be mated with a plug connector 100 that could be mounted on a bulkhead and would also be attached to wires of another harness or it could be in the form of a header mounted to a printed circuit board in an electrical or electronic module.

The electrical connector shown in FIG. 1 is also intended to be sealed so that the mated electrical connectors 10, 100 do not provide a leak path for liquids or water. In this embodiment, individual wire seals can be positioned on individual wires entering the cap connector 10. An interfacial seal or gasket seal 120 is also located in the plug connector 100 in a position to engage the shroud of the cap connector 10. The sealing interface established by these connectors, however, is compatible with the use of both primary and secondary locks to retain terminals in the respective connector housings.

Figure 7:
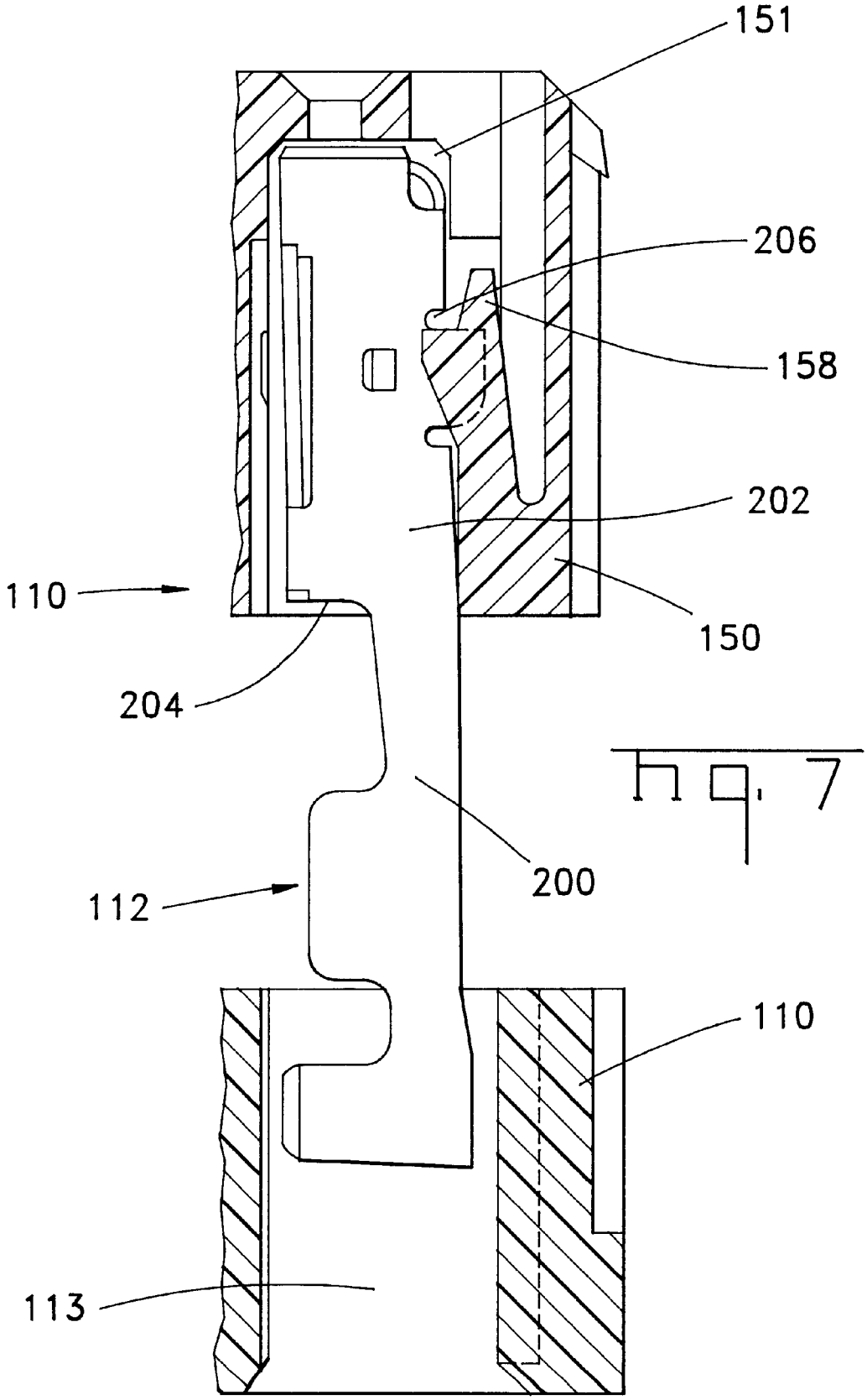
FIG. 7 is a partial section view showing a receptacle terminal mounted in the front and rear portions of the plug housing. A secondary lock plate is not shown in this view, but the slot between the front and rear plug housing sections, in which the secondary lock is to be inserted, is shown in this view.
Figure 9:
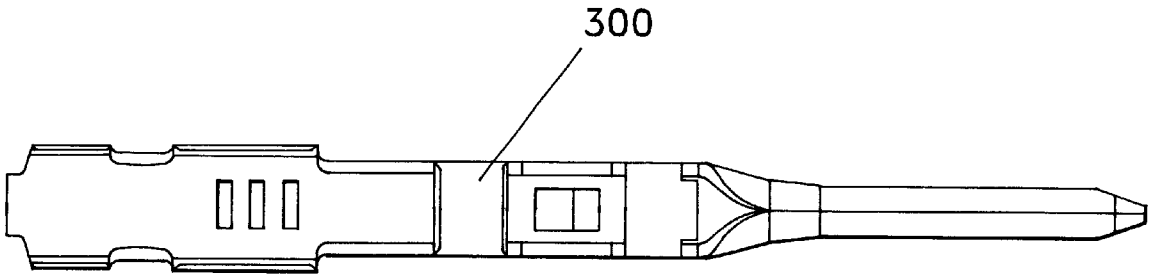
FIG. 9 is a view of one of the stamped and formed blade terminals that can be used in this connector assembly.

Female receptacle terminals 200 used in the plug connector 100 are shown in FIG. 7. Male blade terminals 300 mounted in the cap connector 10 are shown in FIG. 9. Other blade and receptacle terminals, including terminals of different sizes can also be used in this connector assembly, but the terminals 200 and 300 are representative of these terminals. The other major components of both connectors 10 and 100 are shown in FIG. 1. The cap connector housing assembly 10 includes a molded front housing section 30 and a separately molded rear housing section 60. These two housing sections 30 and 60 can be attached by screws or fasteners or can be ultrasonically bonded to each other to form the main cap connector housing. In addition to the main two section connector housing, the cap connector also includes an alignment plate 20 and two secondary locking plates 40 and 50 and these three components are movable relative to the assembled housing sections 30 and 60 as well as relative to each other. The cap connector assembly 10 also includes a molded wire dress cover 70 that can be snapped to the rear housing section 60 and a bolt 70 that is used to mate the cap connector 10 to the plug connector 100.

The plug connector 100 also includes a two part main housing subassembly comprising of a molded rear housing section 110 that is assembled to a separately molded front housing section 150. As with the cap connector housing, the main plug connector housing can be fabricated by assembling the rear housing section 110 to the front housing section 150 using screws or other fasteners or by ultrasonically bonding the two molded members together. Other means of attaching, fastening or bonding two molded members together can also be employed. The plug connector 100 also includes two sliding secondary locking plates 130 and 140 for retaining receptacle terminals 200 in the housing formed of sections 110 and 150. An elastomeric gasket or interfacial seal is mounted on the rear housing section 110 in a position to engage the shroud of the cap connector rear housing section 60 when the two connectors 10 and 100 are mated. A threaded nut (not shown) is insert molded in the plug front housing section 150 in a position to engage the bolt or jackscrew 80 in the cap connector 10 to provide means for applying a mating force between the two connectors 10 and 100.

Figure 2A:
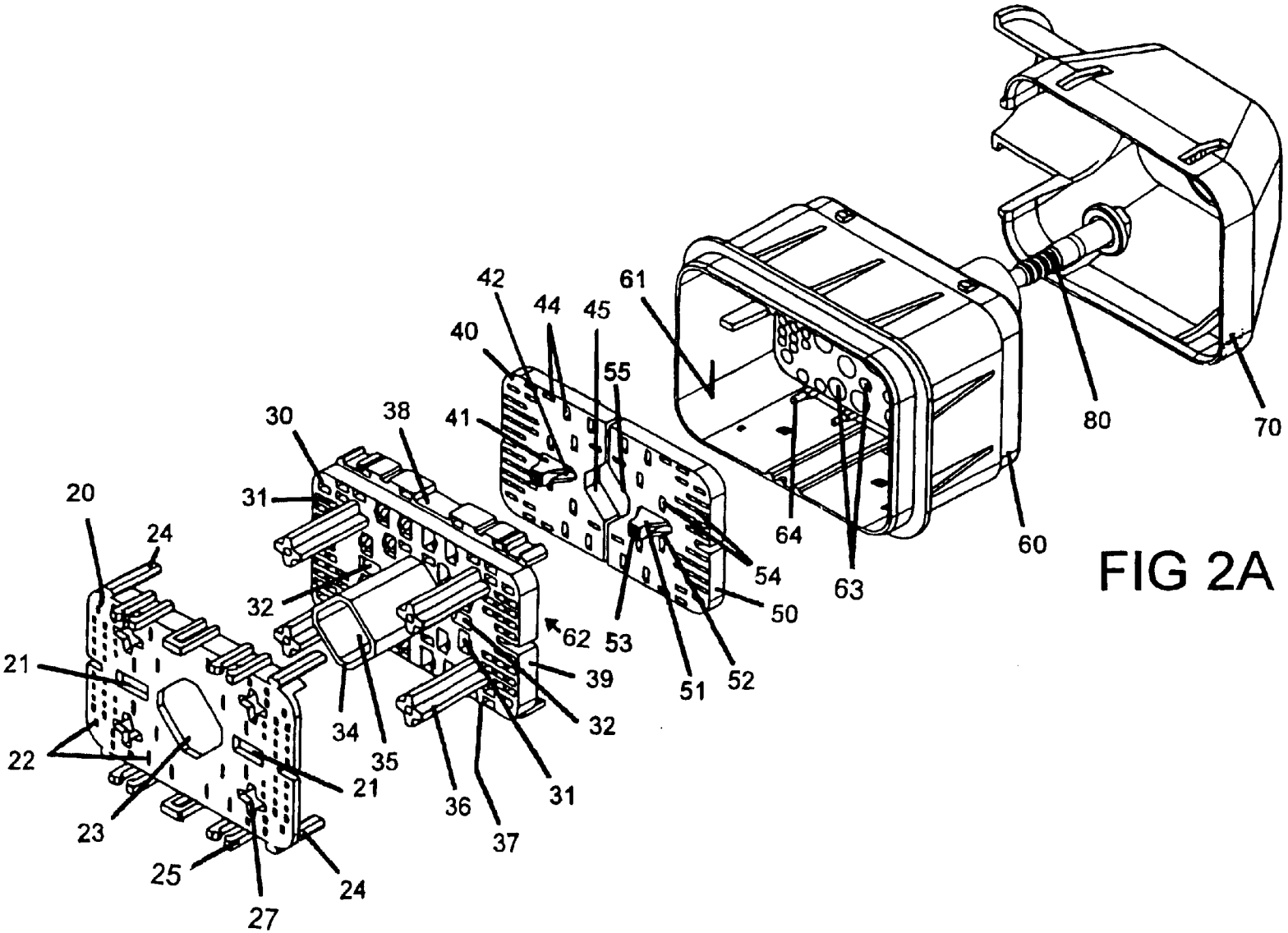
FIGS. 2A and 2B are exploded views, facing in opposite directions, of the housing components of the cap connector.
Figure 2B:
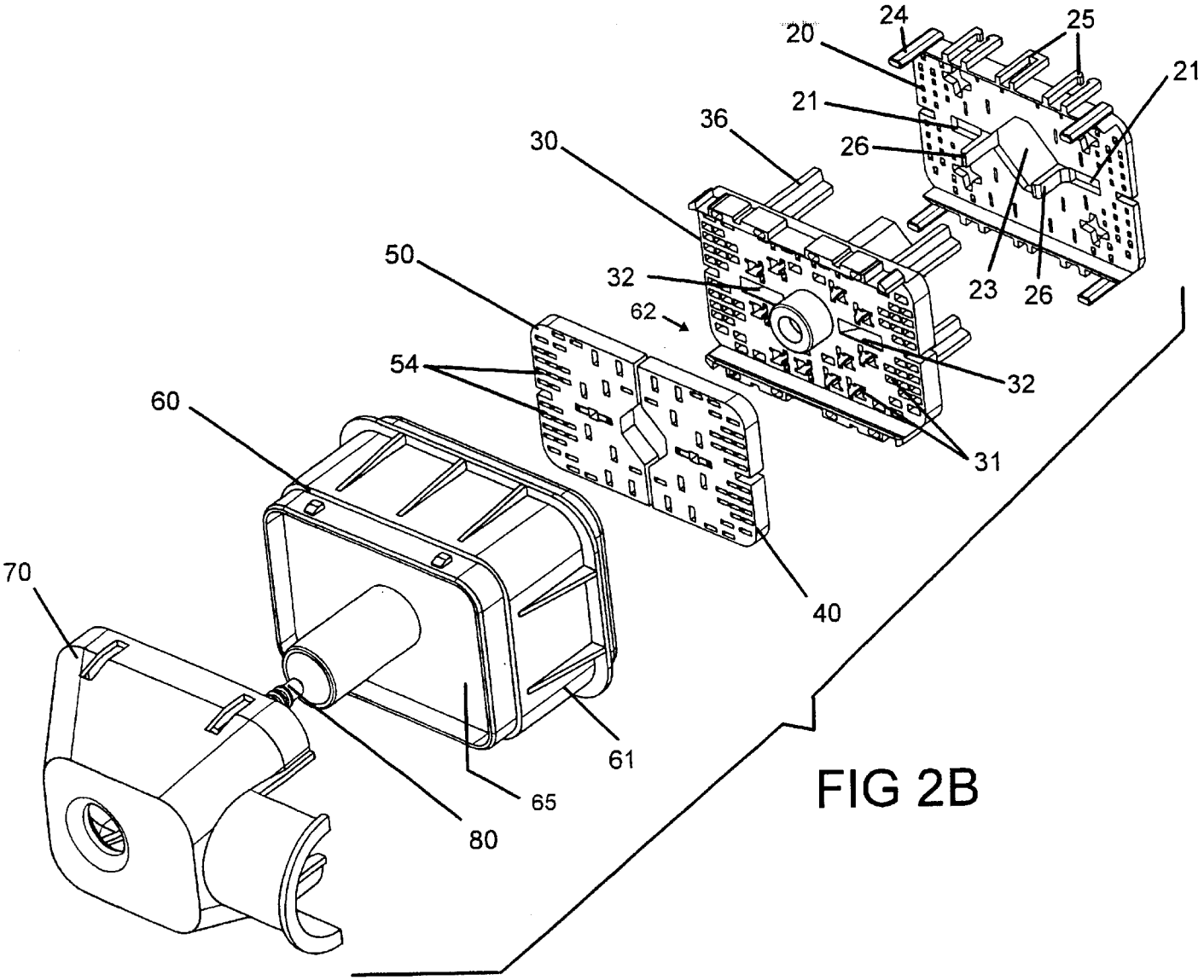
Figure 5:
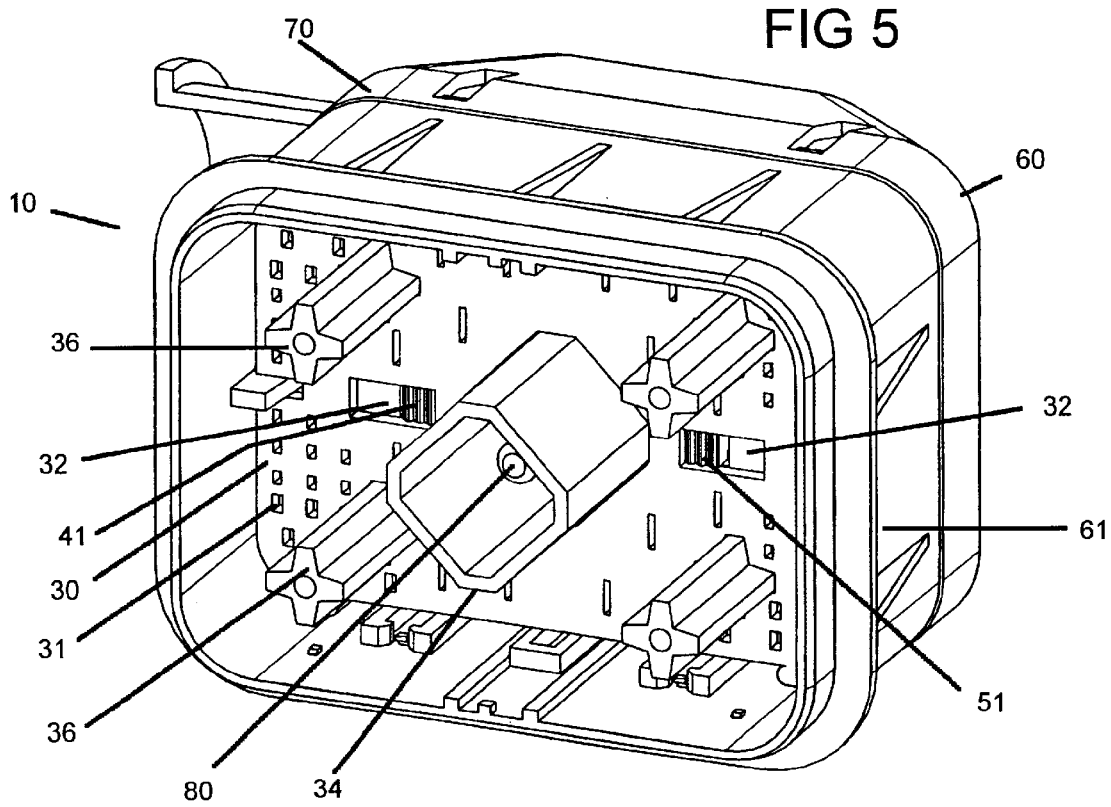
FIG. 5 is a three dimensional view of an assembled cap connector housing from the perspective of the mating face of the cap connector. The alignment plate is not shown in this view.

Details of the cap connector housing subassembly are shown in FIGS. 2A and 2B, two exploded views taken from opposite sides. FIG. 5 shows this assembled connector housing, but does not include the alignment plate 20. The alignment plate 20 is located on the front of the housing subassembly, but is not permanently attached to the other cap housing components. The two secondary locking plates 40, 50 are mounted between the front housing section 30 and the rear housing section 60 prior to attachment of the two housing sections to each other. After the front housing section 30 is permanently attached to the rear housing section 60, the two secondary locking plates 40, 50 are trapped between the two housing sections in a secondary locking slot. The secondary locking plates 40, 50 are however movable toward and away from each other. In an open position the secondary locking plates provide clearance to allow insertion of terminals into the housing subassembly. In a locking or fully engaged position, blade terminals 300, shown in FIG. 9, are held in the housing subassembly by these secondary locking plates 40, 50, in addition to primary terminal latches molded as part of the housing.

The alignment plate 20 is employed to guide the male blade terminals 300 relative to the receptacle terminals 200 during mating to prevent stubbing. Alignment plate 20 is molded and includes a number of openings 22 that are arranged and sized to receive the blades of individual terminals 300. Individual terminal openings 22 can be of different sizes since this connector assembly would normally employ terminals of different sizes. The alignment plate 20 also includes two rectangular openings 21 located on opposite sides of a central tower opening 23. The rectangular openings 21 are intended to provide access to protrusion 41 and 51 on secondary locking plates 40 and 50 respectively. These protrusions 41, 51 are used to shift the secondary locking plates 40, 50 between open and fully engaged positions and these protrusions are shifted by an installation fixture that access locking plates on the connector mating face. Guide arms 24 are located at each corner of the alignment plate 20. These guide arms 24 extend inwardly from the plane of the alignment plate 20 and are received within channels on the front housing so that the alignment shifts along the rectilinear mating path traversed by male and female terminal as they are mated. The alignment plate 20 also includes latching arms 25 located along opposite sides. These latch arms engage tabs on the plug connector so that the alignment plate returns to the entry position when the two connectors are unmated. Alignment plate 20 also includes cruciform shaped openings 27 through which alignment posts 36 on the front cap housing section extend.

The front cap housing section 30 is molded from conventional plastic and includes terminal cavities 31 extending between a mating face shown in FIG. 2A and an interior face shown in FIG. 2B, which will form one side of a secondary lock slot. The front housing section 30 also includes two rectangular openings 32 through which protrusions 41, 51 on the secondary locks will extend so that they are accessible on the mating face of the housing subassembly. These openings 32 are located on opposite sides of the central tower 34 which comprises a continuous wall surrounding an central opening 35 through which the mating assist bolt or jackscrew 80 is to extend. Four cruciform alignment posts 36 extend from the mating face of the front cap housing section 30. These alignment posts 36 extend through openings 27 in the alignment plate and will be received in openings on the plug connector 100 when the two connectors are mated. Housing section 30 also includes openings 37 through which guide arms 24 on the alignment plate 20 extend. The front housing section 30 has a generally rectangular shape with ledges extending from top and bottom longer sides 38 leaving space for a secondary lock slot 62 which extends between the shorter sides 39.

The main cap housing also includes a rear molded housing section 60 shown from opposite sides in FIGS. 2A and 2B. The main housing is molded as two separate sections to simplify the molds used to form these components. The rear housing section 60 includes a shroud 61 that is continuous and extends from a rear housing base 65. The base 65 and the shroud 61 form an open ended pocket in which the front housing section 30 and the secondary locks 40, 50 are located. Openings 63, shown in FIG. 2A and FIG. 8 extend through the base 65. These openings 63 are large enough to permit insertion of terminal blades 300 are inserted. Each opening also includes a continuous sealing surface 66 shown in FIG. 8 which would be engaged by a conventional wire seal attached to the terminal 300. These openings are omitted from FIG. 2B, which shows the basic molded part, because the exact position of these openings 63 will depend upon the types of terminals that are actually used in any specific embodiment of this invention. The base 65 also includes pins 64 extending forward along the top and bottom. These pins are received within complimentary hole on the rear of the front housing section 20 and comprise means for attaching the two housing sections together by ultrasonically bonding or heat staking the plastic pins 64 to the front mating section. Other means for fastening the two housing sections can also be used. For example screws can be used to attach the two housing sections to each other.

The two secondary locks 40, 50 each comprise molded plates having terminal openings 44 and 54 extending between opposite sides. If the terminal positions are symmetrical about a centerline extending between the two locks, then the secondary locks 40, 50 would be identical. Each secondary lock 40, 50 includes a protrusion 41, 51 extending toward the mating face of the connector assembly. The protrusions 41, 51 are located adjacent to recesses 45, 55 on the inner edges of the locks. The protrusion 51 has inclined surfaces 52 on opposite sides of the protrusion adjacent the base of the protrusion. The distal end 53 of the protrusion has a generally rectangular shape and the top surfaces is ribbed so that it can be manipulated by an installer to move the secondary lock between open and closed positions. Protrusion 41 has the same shape as protrusion 51.

The cap connector 10 is assembled by first positioning the two secondary locks 40, 50 in the slot 62 on the rear of the front housing section 30. The protrusions 41, 51 extend through lock protrusion openings 32 so that the secondary locking plates are accessible on the front or mating face of the front cap housing section 30 The rear housing section 60 is then attached to the front housing section 30, trapping the secondary locking plates 40, 50 in the slot 62. The end walls of the shroud 61 as well as the protrusions 41, 51 prevent the secondary locking plates 40, 50 from being removed from the slot 62 and also prevent access to the ends of the locking plates. The protrusions 41, 51 are, however, accessible on the mating face of the front housing section 30 and through the open front of the cavity formed by the housing shroud 61. With the two housing sections 30, 60 trapping the secondary locks 40, 50, the two housing sections are attached. In the embodiment shown herein the pins are deformed by ultrasonic or other means to attach the two housing sections together. Limited movement of the secondary locks 40, 50 in the slot 62 is still possible because the locks are not affixed to the assembled housing. only limited movement is possible because the protrusions 41, 51 can only move between opposite ends of the openings 32 in the front housing section 30. When the lock protrusions 41 are moved into contact with the outer edges of openings 32, the terminal openings 44, 54 are aligned with terminal openings 31 and 63 in the front and rear housing sections respectively. In this open position, sufficient space is provided for insertion of terminals, such as blade terminals 300 into the cap housing subassembly of cap connector 10. Of course it is possible to insert terminals of different sizes into the same connector in which case the terminal openings and the terminals will differ from those specifically intended to receive blade terminals 300. However, these other terminals are also of conventional construction. When the secondary locking plates 40, 50 are shifted outwardly into engagement with the inner edges of openings 32, the locking plates will be in the closed or fully engaged position in which they will either lock or provide auxiliary locking of the terminals in the housing subassembly. One means of providing primary locking and secondary locking will be described in more detail with respect to FIGS. 7 and 8. Terminal position assurance can also be provided, and this housing configuration is compatible with terminal latching or locking configurations other than the representative embodiments shown herein.

The bolt 80 can be inserted into the housing subassembly from the rear and trapped in a conventional manner so that it can rotate relative to the connector 10, but in which it will not advance relative to the cap connector 10 but will instead draw the plug connector 100 into engagement with the cap connector 10 or vice versa if the plug connector 100 is fixedly mounted on a stationary component. Typically the bolt will be assembled to the housing subassembly before the terminals 300 with wires crimped to the terminal rear ends are inserted into the terminal cavities. After the terminals 300, with individual wire seals are inserted into the housing, the wire dress cover 70 can be snapped on the rear of the housing section 60. The wire dress cover 70 can be mounted so that the wire exit extends in either of two opposite directions.

Figure 3A:
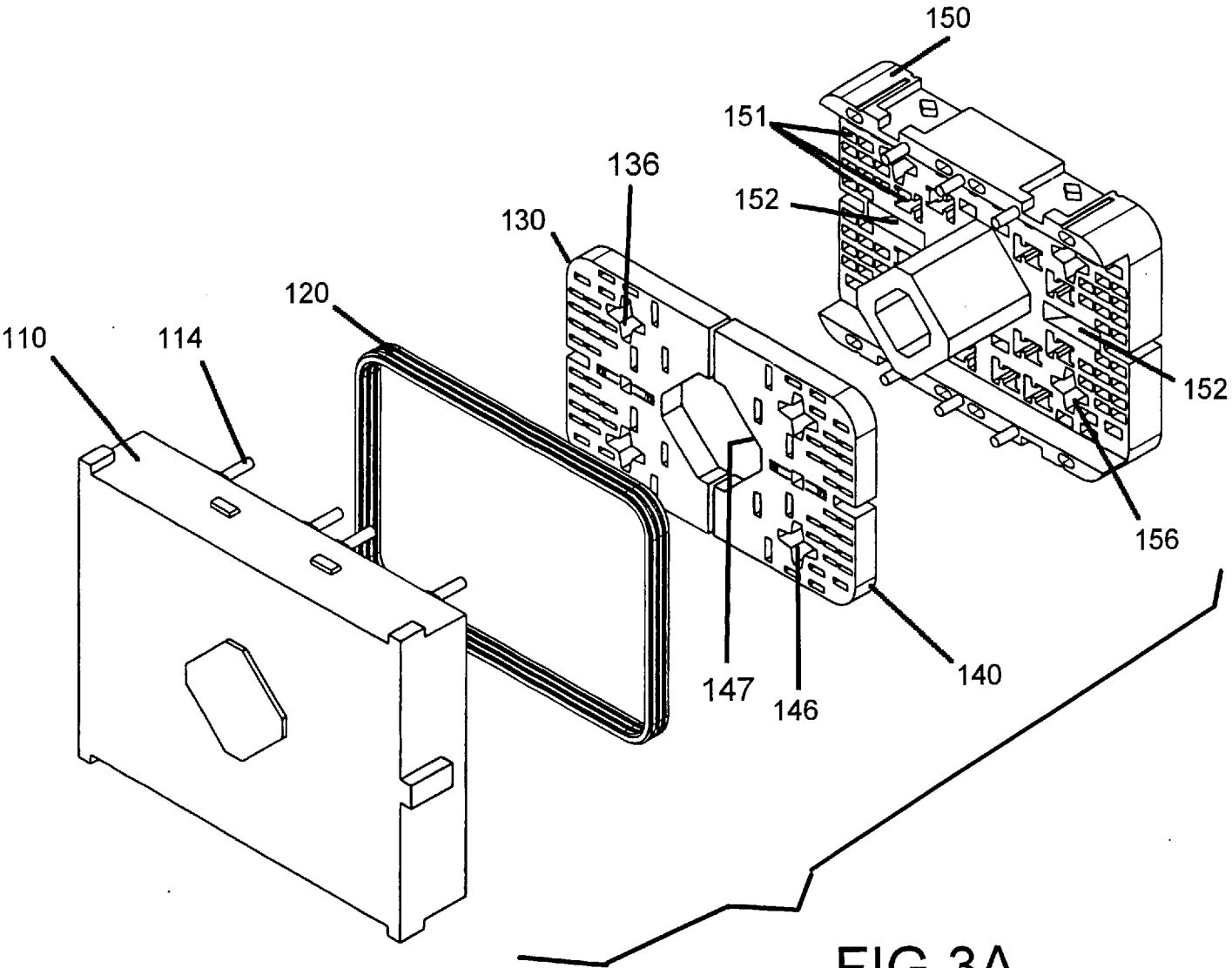
FIGS. 3A and 3B are exploded views, facing in opposite directions, of the housing components of the plug connector.
Figure 3B:
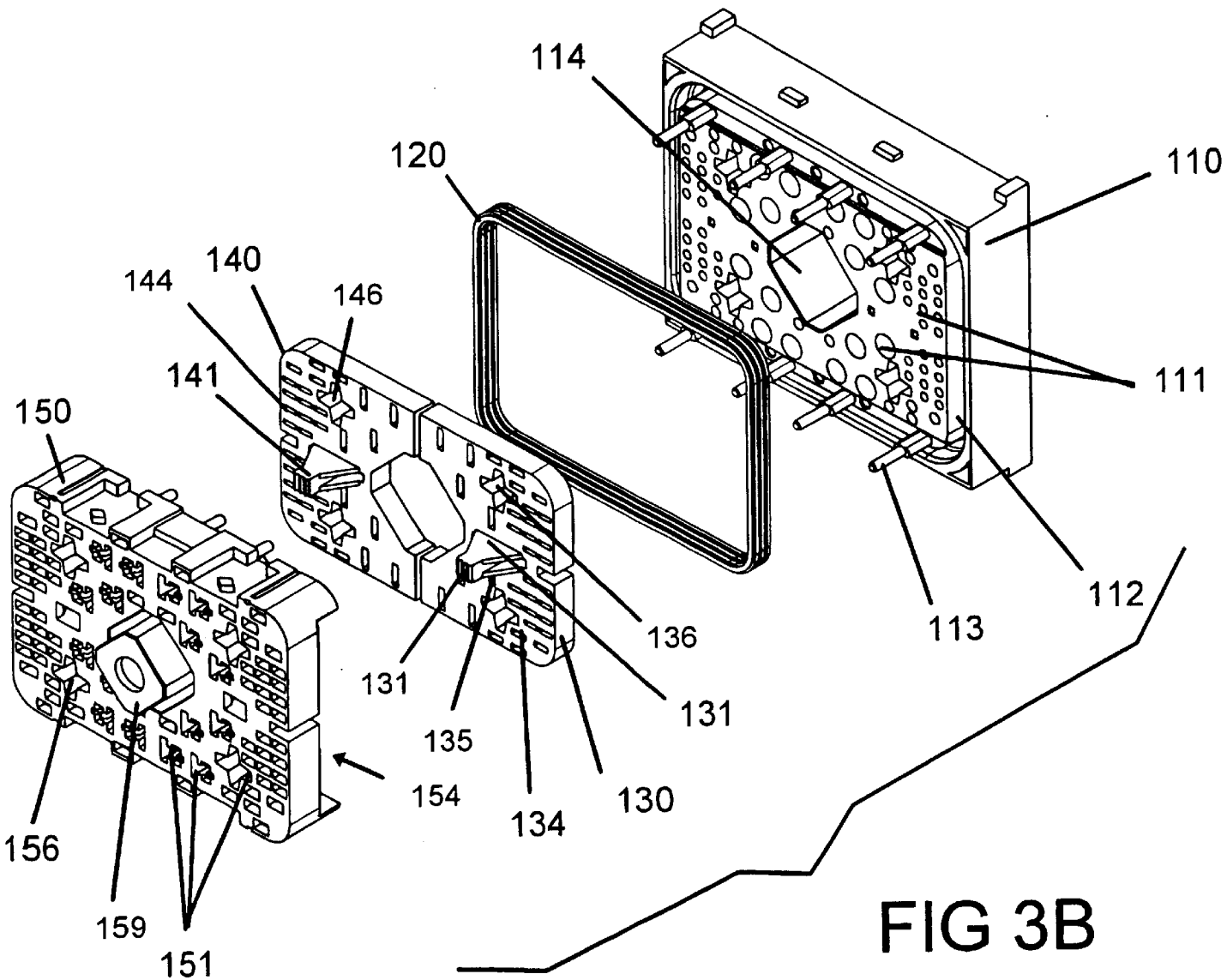

The plug connector housing assembly shown from opposite sides in FIGS. 3A and 3B also includes a two part main housing with two sliding secondary locking plates 130, 140 located in a secondary locking slot 154 between the front plug housing section 150 and the rear plug housing section 110. FIG. 3A shows the general outline of the rear plug housing 110, but does not show terminal cavities extending through the rear face of the rear plug housing 110. This omission is intended to show that terminal cavities can be located in different positions depending upon the mix of different types of conventional terminals that can be used in this connector configuration. FIG. 3B, however, does show one configuration of the cylindrical seal surfaces 111 that would extend completely through the rear plug housing 30. As shown in FIG. 3B, the rear plug housing section 110 also includes a peripheral groove 112 extending around the portion of the housing section 110 containing the terminal openings or seal surfaces 111. An elastomeric gasket seal 120 having a plurality of deflectable ridges is positioned in this groove 112. The groove 112 is wide enough to receive the front lip of the cap connector shroud 61, and the outer ridges on the seal 12 will engage the shroud lip to form a waterproof barrier around the periphery of the connector assembly.

Pins 113 extending along the top and bottom of the rear cap housing section are used to fasten the rear cap housing section 110 to the front cap housing section 150, by ultrasonic bonding or equivalent fastening means. These pins 113 or fastening means are located on the inside of the peripheral seal groove 112 so that they will not interfere with the seal established with the cap connector shroud 61. A central recess 114 provides clearance for a rear tower on the plug front housing section 150.

As with the cap housing sections, the front plug housing section 150 and the rear plug housing section are separately molded to simplify the molds used to fabricate these components. The front plug housing contains a plurality of terminal openings 151, which in the preferred embodiment are intended to receive receptacle terminals such as the terminals 200 shown in FIG. 7. Plug front housing section 150 also includes two rectangular openings 152 located beside a central tower 155 extending from the rear of the front plug housing section 150. These openings 152 are dimensioned to receive the secondary lock protrusions 131, 141 on the plug secondary locking plates 130, 140. These openings allow sufficient movement of the protrusions 131, 141 for the secondary locking plates 130, 140 to move between an open terminal insertion position and a closed terminal latching position when all terminals are fully inserted in the assembled plug housing formed by attaching the front housing section 150 to the rear housing section 110. Cross shaped openings 136, 146, alignable with similar openings 156 on the front plug housing, provide clearance for the alignment posts 36 on the cap connector 10.

The front plug housing section 150 also includes two ledges 157, 158 extending rearwardly to form a secondary lock slot 154 in which the two sliding locking plates 130, 140 are positioned. Holes on these ledges receive the pins 113 which are inserted and deformed after the secondary lock plates 130, 140 are positioned in the slot 154. A rear tower 155 extends through the slot 154, and as seen in FIG. 3B, this tower 155 provides space for a front tower 159 in which a bore is defined to receiving the bolt or jackscrew 80 and in which an insert molded, treaded nut (not shown) is located to engage bolt 80. A channel surrounds this front tower to provide clearance for the walls forming the cap tower 34.

The two secondary plug locking plates 130, 140 are similar, though not identical, in construction to the cap locking plates 40 and 50. Each plug locking plate includes terminal openings 134, 144 which permit terminals, such as receptacle terminal 200 to be inserted through the locking plate and also include surfaces that will hold the terminals 200 in place when the plug locking plates 130, 140 are shifted into their locked or fully engaged positions. The precise configuration of these terminal engaging surfaces will depend upon the particular terminal used in the respective position in the connector, but these configurations are conventional in nature. For example a shoulder partially protruding into the terminal opening, and behind a surface or edge on the terminal when the terminal is properly inserted into the assembled connector housing.

Each secondary locking plate 130, 140 also includes a protrusion 131, 141 extending from the front of the molded locking plate toward the mating face of the plug connector. As shown in FIG. 3B, protrusion 131 includes tapered edges 135 at the base of the protrusion and a rectangular portion on the forward end. Ridges on the front face of protrusion 131 will help an installer or a maintenance technician laterally shift the locking plate 130 laterally between an open terminal insertion position and a closed position in which the secondary locking plate engages fully inserted terminals to prevent inadvertent retraction of the terminal from the housing subassembly. Protrusion 141 has a similar configuration. The inner edges 137, 147 of the secondary locking plates provide clearance for the tower 155 extending rearwardly from the front plug housing section 150.

The multi-component plug housing is assembled in much the same manner as the cap connector housing. The secondary locking plates 130, 140 are positioned in the locking plate slot 154 between opposing faces of the front and rear housing sections before the pins 113 are deformed to attach the rear plug housing section 110 to the front plug housing section 150. The protrusions 131, 141 extend through the two openings 152 in the front housing section so that the secondary locking plates are trapped, with only limited lateral movement, between the two housing sections, but the protrusions 131, 141 are also accessible from the mating face of the plug housing assembly. An installer or maintenance technician can shift the locking plates between open and closed positions. However unlike the cap locking plates 40, 50, the plug locking plates 130, 140 are in an open or terminal insertion position when the plates 130, 140 are in their outermost lateral position. When the plug locking plates 130, 140 are shifted laterally inwardly, parallel to the mating face, suitable shoulders in the terminal openings 134, 144 will be brought into engagement with corresponding surfaces on the terminals to lock the terminals in their fully inserted position. In alternate configurations, the secondary locking plates can be brought into engagement with primary latches on the main housing without engaging the terminals directly.

Figure 4A:
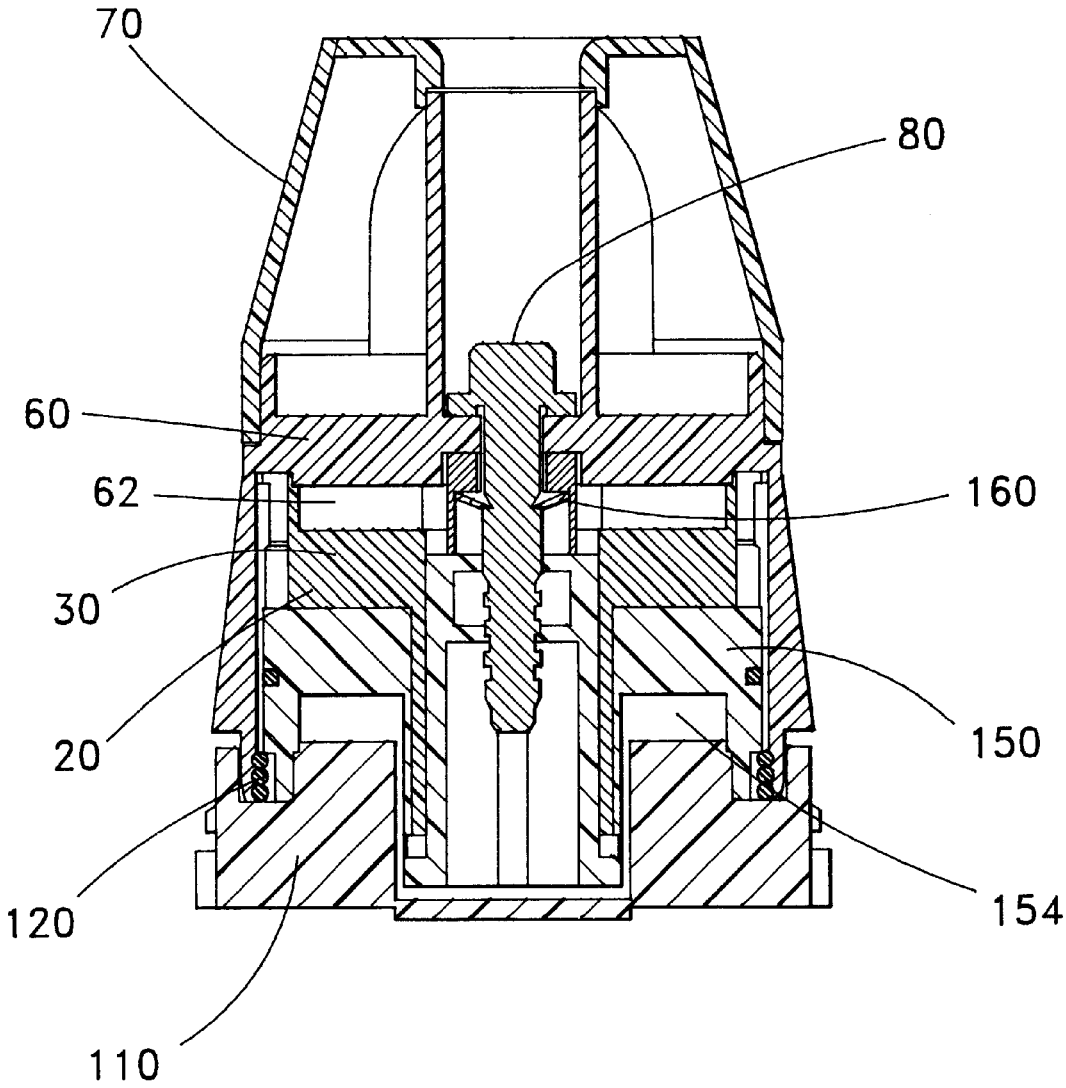
FIGS. 4A and 4B are sectional views, taken along section lines extending perpendicular to each other through the center of the connector assembly, showing the mated configuration of the cap and plug connectors. Terminals are not shown to avoid confusion.
Figure 4B:
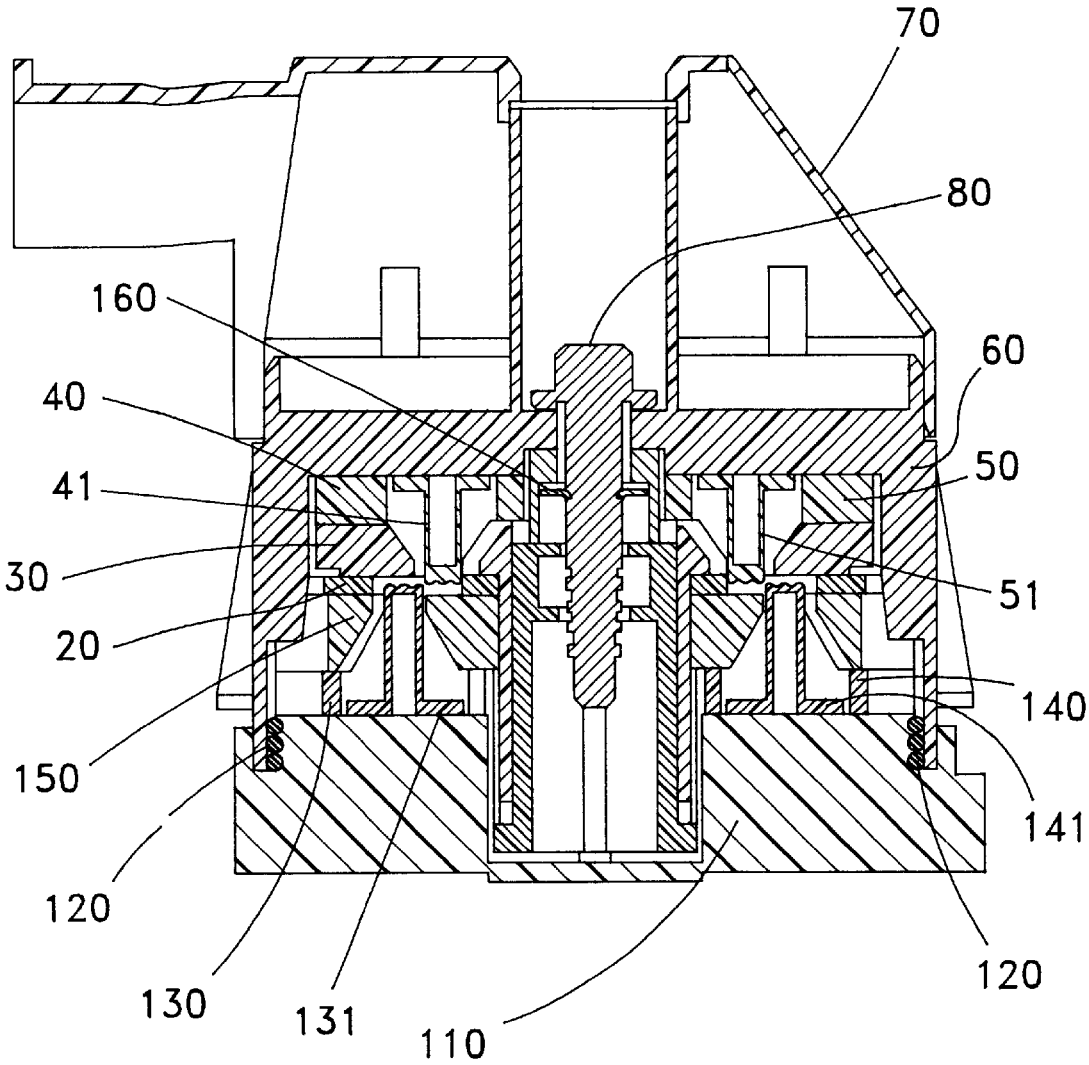
Figure 6:
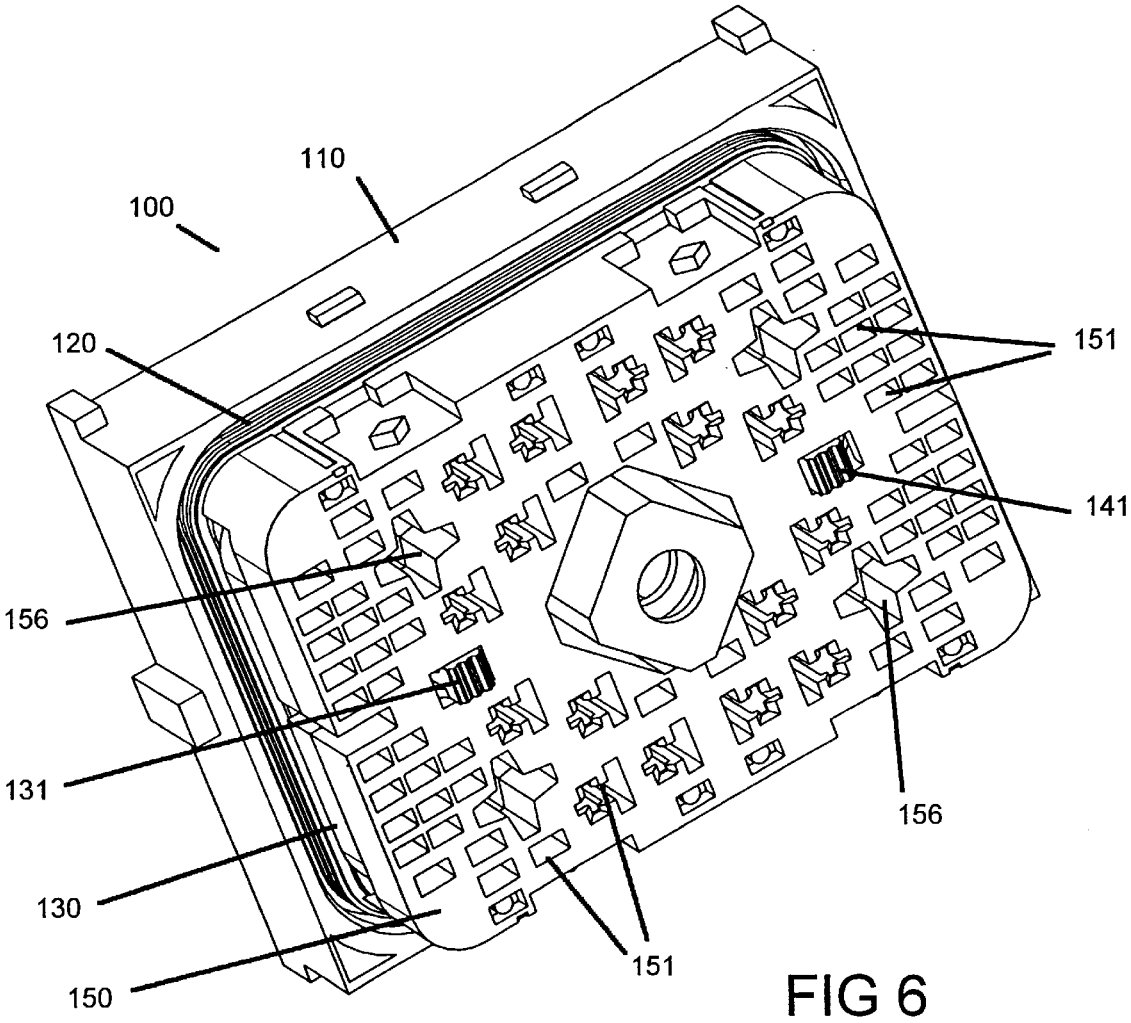
FIG. 6 is a three dimensional view of an assembled plug connector housing from the perspective of the mating face of the plug connector.
Figure 10:
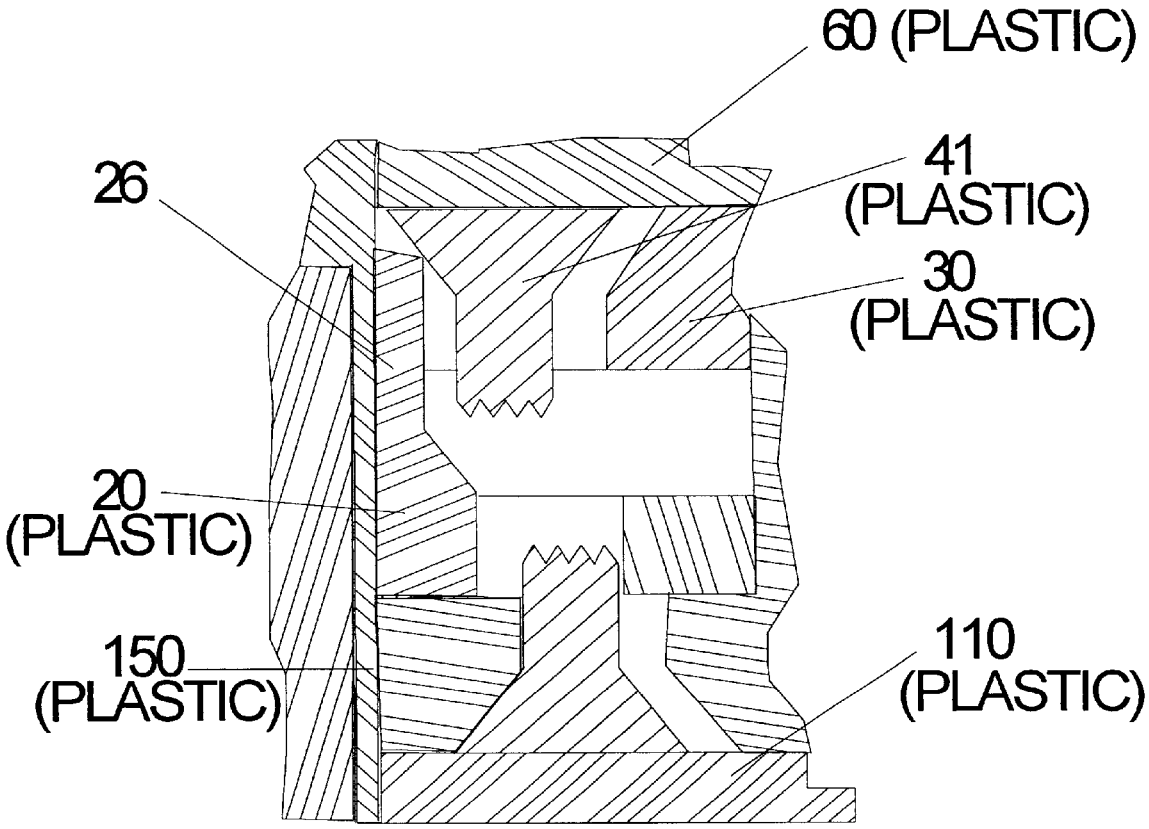
FIG. 10 is a view showing the manner in which the alignment plate can shift secondary locking plates into their fully locked positions.

FIG. 5 shows the assembled cap connector 10 and FIG. 6 shows the assembled plug connector 110. For clarity, the terminals are not shown in either connector. The alignment plate 20 can be mounted on the front of the cap connector 10 in an extended position over the ends of the terminal blades 300. As the cap connector 10 is mated to the plug connector 110, the alignment plate moves to a collapsed position shown in FIGS. 4A and 4B, but the alignment plate 20 keeps the terminals blades 300 properly aligned and straight relative to the receptacle terminals 200 during mating. In the event that the locking plates 40, 50 on the cap connector are not in their fully engaged laterally outward positions, then the camming fingers 26, shown in FIG. 2B, extending rearwardly from the alignment plate 20 will engage the lateral sections 42, 52 on the secondary locking plates 40, 50 to shift these plates into the closed position shown in FIG. 10. These camming fingers 26 are located adjacent the tower openings 23 and will be laterally supported by the tower walls 34 during mating. If one or more of the terminals in the cap connector is not properly inserted so that either locking plate 40, 50 cannot shift to the fully inserted position, then the camming fingers 26 will push the corresponding protrusion 41 or 51 and close the plates during mating. Thus the camming fingers serve not only as means for insuring that the secondary locking plates 40, 50 are in the fully locked position, but also prevent mating if all of the terminals 300 are not in their proper positions.

Figure 8:
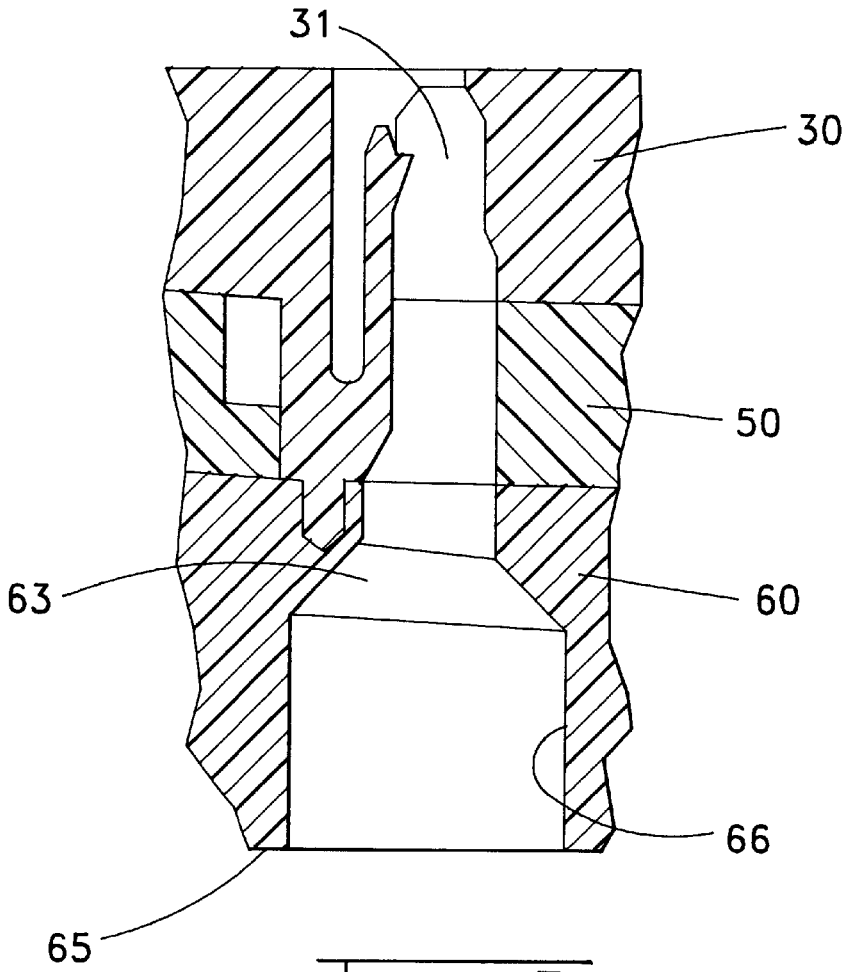
FIG. 8 is a section view of a terminal cavity for a large terminal in which the primary latch extends through the secondary lock slot. A secondary lock is shown in the secondary lock slot in this view.

FIGS. 7 and 8 are section views showing the manner in which the terminals are retained in the housing and in which the secondary locking plates are shifted laterally relative to the terminals. FIG. 7 shows a configuration in which a primary latch 158 located on the plug front housing section 250 engages an opening 206 on the receptacle portion 202 of the terminal 200. A terminal opening adjacent a shoulder 204 is located in the secondary locking slot 154 and when one of the secondary locks 130, 140 is shifted into the fully locked position, a shoulder extending into a terminal opening 134, 144 (FIG. 3B) will engage the terminal 200 at this point. FIG. 8 shows another configuration, primarily intended for use with a larger terminal, in which the primary lock extends into the secondary locking slot. Note, however that the front housing section on either connector can still be molded by straight pull mold tooling, without side pulls, for either configuration. The rear housings can similarly be molded with straight pull tooling so that the housings can be molded in a less expensive manner.

In one alternate embodiment of this invention, the rear plug housing can be molded as part of another component. For example a junction box can be molded with a portion of the junction box serving as the rear plug housing. Receptacle terminals, attached to wires could be inserted through openings in the section of the junction box and the front plug housing section could be attached to this portion of the junction box. Similarly terminals mounted on a printed circuit board could be inserted through a rear plug housing of this type. This approach is possible in part because the various molded components of the housing can be formed of different materials. For example, relatively more expensive plastics can be used to mold components which may be subjected to adverse environmental conditions. Less expensive plastics could then be used for other less sensitive components.

The representative embodiment of this invention depicted herein is not the only version of an electrical connector or an electrical connector assembly in accordance with this invention. Therefore the following claims define this invention, which is not limited to the preferred embodiment depicted herein.

I claim:

1. An electrical connector matable with a mating electrical connector and comprising a housing and terminals positioned in the housing, the electrical connector including a lock member, separate from the housing, shiftable parallel to a mating face of the housing into an engaged position in which the lock member prevents retraction of terminals extending through the lock member from the housing, the lock member including a surface accessible from the mating face to provide means for shifting the lock member into the engaged position.

2. An electrical connector matable with a mating electrical connector and comprising a housing and terminals positioned in the housing, the electrical connector including a secondary lock shiftable parallel to a mating face of the housing into an engaged position in which the secondary lock prevents retraction of terminals from the housing, the secondary lock including a protrusion extending toward the mating face and accessible on the mating face to provide means for shifting the secondary lock into the engaged position.

3. The electrical connector of claim 2 including two opposed secondary lock members, each secondary lock member being shiftable transversely relative a side of the housing.

4. The electrical connector of claim 3 wherein the opposed secondary lock members are shiftable toward each other into engaged positions.

5. The electrical connector of claim 3 wherein the opposed secondary lock members are shiftable away from each other into engaged positions.

6. The electrical connector of claim 2 wherein the secondary lock comprises a flat plate having a plurality of openings with the protrusion extending transversely relative to the flat plate.

7. The electrical connector of claim 2 wherein the protrusion comprises two inwardly tapered oppositely facing surfaces extending from the secondary lock to a distal section having a rectangular cross section.

8. The electrical connector of claim 2 wherein the protrusion is located adjacent to an interior edge of the secondary lock.

9. The electrical connector of claim 2 wherein the housing includes two separate molded housing members, the separate molded housing members being secured to each other with a slot formed between the two separate molded housing members, the secondary lock being shiftable in the slot.

10. The electrical connector of claim 9 wherein an inner molded housing member adjacent the connector mating face includes an opening through which the protrusion extends, the opening being larger than the protrusion to permit movement of the protrusion as the secondary lock moves between an engaged position and a retracted position.

11. An electrical connector matable with a mating electrical connector and comprising a housing subassembly and terminals located in the housing subassembly;

the housing subassembly comprising a main housing, at least one lock member and an alignment plate;

the lock member being shiftable relative to the main housing to a locking position and comprising means for securing the terminals in the electrical connector;

the alignment plate being movable relative to the main housing and the shiftable lock member during mating with the mating electrical connector, the alignment plate comprising means for guiding terminals during mating with mating terminals in the mating electrical connector, the alignment plate also including a first surface engagable with a second surface on the shiftable lock member to shift the lock member into the locking position if the shiftable lock member has not been previously shifted to the locking position.

12. The electrical connector of claim 11 wherein the alignment plate is movable on a path toward the main housing member during mating with the mating electrical connector, and the lock member is shiftable transverse to the path traversed by the alignment plate during mating with the mating electrical connector.

13. The electrical connector of claim 12 wherein the lock member is shiftable in a direction parallel to a mating face of the housing subassembly.

14. The electrical connector of claim 13 wherein the lock member includes a protrusion extending toward the mating face of the housing subassembly and the second surface is located on the protrusion.

15. The electrical connector of claim 14 wherein the alignment plate includes an opening through which the protrusion extends when the electrical connector is mated with the mating electrical connector, the first surface being located on a side of the opening.

16. The electrical connector of claim 11 wherein the housing subassembly includes two lock members, each comprising a locking plate slidable transverse to side surface of the main housing with the alignment plate being movable along a path perpendicular to the locking plates.

17. The electrical connector of claim 11 wherein the main housing comprises a rear housing member attached to a front housing member with the lock member being located in a slot between the front and rear housing members.

18. The electrical connector of claim 17 wherein the rear housing member comprises a shroud surrounding the front housing member and the front housing member, and the lock member includes a protrusion extending toward a mating face of the electrical connector, the protrusion being accessible on the mating face to shift the lock member parallel to the mating face and within the slot and the shroud.

19. The electrical connector of claim 18 wherein the alignment plate in movable further into the shroud during mating with the mating electrical connector.

20. The electrical connector of claim 18 wherein the alignment plate is removable from the housing subassembly to permit access to the protrusion so that the lock 20 member can be shifted between a locking position and an unlocking position.

21. An electrical connector comprising a molded housing and terminals positioned in the housing, the housing including a front housing member attached to a rear housing member with a slot extending between the front housing member and rear housing member, the connector also including a locking plate shiftable in the slot between a first position permitting insertion of the terminals into the housing and a second position in which the locking plate retains the terminals in the housing, wherein the locking plate can be positioned between the front housing member and the rear housing member before attachment of the front housing member to the rear housing member to simplify molding the housing.

22. An electrical connector assembly comprising a plug connector and a cap connector;

the cap connector comprising first terminals in a cap housing subassembly including a molded rear cap housing including a molded front cap housing attached to the rear housing with at least one cap locking plate located between the front and rear housing, each cap locking plate being shiftable relative to the front and rear cap housings in a cap lock slot formed between the front and rear cap housings;

the plug connector comprising second terminals in a plug housing subassembly, the plug housing subassembly including a molded rear plug housing and a molded front plug housing attached to the rear plug housing with at least one plug locking plate located between the front plug housing and the rear plug housing, each plug locking plate being shiftable relative to the front and rear plug housings in a plug lock slot formed between the front and rear cap housings;

wherein each cap lock plate can be positioned between the rear cap housing and the front cap housing before the front cap housing is attached to the rear cap housing and each plug lock plate can be positioned between the rear plug housing and the front plug housing before the front plug housing is attached to the rear cap housing to simplify molding of the cap and plug housing subassemblies.

23. The electrical connector assembly of claim 22 wherein each cap lock member and each plug lock member is accessible respectively on a mating face of the cap connector and the plug connector so that the lock members can be shifted into a position securing the terminals in the respective housing subassemblies.

24. The electrical connector assembly of claim 22 wherein each cap lock member and each plug lock member comprise secondary lock members.

25. The electrical connector assembly of claim 22 wherein the rear cap housing includes a peripheral shroud, the front cap housing and each cap locking plate being surrounded by the shroud.

26. The electrical connector assembly of claim 25 wherein two opposed cap locking plates are located in the cap housing subassembly, each cap locking plate being shiftable transversely relative to the shroud and within the shroud with the shroud enclosing the cap locking plates.

27. The electrical connector assembly of claim 26 wherein the plug housing subassembly includes two opposed plug locking plates and the plug housing subassembly is insertable into the shroud when the plug connector is mated with the cap connector.

28. The electrical connector assembly of claim 27 wherein the cap locking plates are shiftable away from each other into a cap locking position and the plug locking plates are shiftable toward each other into a plug locking position.

29. The electrical connector assembly of claim 22 wherein the cap housing subassembly includes two opposed cap locking plates and the plug housing subassembly includes two opposed plug locking plates, the cap locking plates being shiftable in a first direction into a cap locking position to prevent disengagement of terminals in the cap connector and the plug locking plates being shiftable in an opposite second direction into in plug locking position to prevent disengagement of terminals in the plug connector.

30. The electrical connector assembly of claim 29 wherein the front cap housing and the front plug housing include primary terminal latches, the cap locking plates and the plug locking plates comprising secondary means for retaining terminals in the corresponding housing subassemblies.

31. A sealed electrical connector assembly comprising a cap connector and a plug connector:

the cap connector including a cap housing with a peripheral shroud forming a part of the cap housing;

the plug connector including a plug housing at least partially insertable in the peripheral shroud when the plug connector is mated to the cap connector and a peripheral seal engagable with the peripheral shroud when the cap connector is mated to the plug connector; and at least one cap locking plate positioned in the cap housing and surrounded on four sides by the shroud, the cap locking plate being shiftable transversely relative to one side of the cap housing and transversely relative to the shroud.

32. The sealed electrical connector assembly of claim 31 wherein each cap locking plate is accessible through an open face of the shroud so that that the cap locking plate can be shifted into a cap locking position while surrounded by the shroud.

33. The sealed electrical connector assembly of claim 32 wherein each cap locking plate includes a protrusion extending toward the open face of the shroud, each protrusion being accessible for shifting the cap locking plate.

34. The sealed electrical connector assembly of claim 31 wherein the cap housing includes a front cap housing member attached to a rear cap housing member with each cap locking plate being positioned between the front and rear cap housing members.

35. The sealed electrical connector assembly of claim 34 wherein a cap locking plate slot is formed between the front and rear cap housings, each cap locking plate being located in the cap locking plate slot and shiftable relative to the front and rear cap housing members.

36. The sealed electrical connector assembly of claim 35 wherein two opposed cap locking plates are located in the same cap locking plate slot, the two cap locking plates being shiftable in opposite directions into a cap locking position.

37. The sealed electrical connector assembly of claim 31 wherein the plug connector includes at least one plug locking plate, the peripheral seal surrounding each plug locking plate when the plug locking plate is in either a locked or and unlocked position.

38. The sealed electrical connector assembly of claim 37 wherein two opposed locking plates are located in a plug locking plate slot between a front plug housing member and a rear plug housing member.

39. The sealed electrical connector assembly of claim 38 wherein the peripheral seal is located on the rear plug housing.

40. The sealed electrical connector assembly of claim 39 including at least one plug locking plate and a movable alignment plate comprising means for guiding terminals in the plug and cap connectors during mating, the alignment plate abutting a plug locking plate that is not in a locked position to prevent the connectors from mating and engaging a cap locking plate that is not in a locked position to urge each disengaged cap locking plate into a cap locking position.

* * * * *